US006047973A

United States Patent [19]

Amore et al.

[11] Patent Number: 6,047,973

[45] Date of Patent: Apr. 11, 2000

[54] IN-LINE SKATE BRAKES

[76] Inventors: Robert Amore, 430 W. 34th St., #7C, New York, N.Y. 10001; Jeffrey M. Lee, 311 23rd St., Santa Monica, Calif. 90402; Mikke Pierson, 130 Paradise Cove, Malibu, Calif. 90265; Kenneth A. Tarlow, 1120 Princeton Dr., #2, Marina del Rey, Calif. 90292; Paul Berman, 1133 N. Clark St., #203, Los Angeles, Calif. 90069

[21] Appl. No.: 08/022,308

[22] Filed: Feb. 25, 1993

[51] Int. Cl.[7] ..... A63C 17/14

[52] U.S. Cl. ..... 280/11.2; 188/5

[58] Field of Search ..... 280/11.2, 11.22, 280/11.23, 11.27; 188/5

[56] References Cited

U.S. PATENT DOCUMENTS

| | | | |
|---|---|---|---|
| D. 315,941 | 4/1991 | Olson et al. | D21/226 |
| D. 321,393 | 11/1991 | Olson et al. | D21/226 |
| D. 323,540 | 1/1992 | Graham | D21/226 |
| 333,583 | 1/1886 | Yarger | 280/11.2 |
| 1,868,548 | 1/1932 | Turner | 280/11.22 |
| 2,203,278 | 6/1940 | Foley | 280/11.18 X |
| 2,229,632 | 1/1941 | Bender et al. | 280/11.2 |
| 2,285,373 | 6/1942 | Wall | 280/11.2 |
| 2,308,251 | 1/1943 | Terzi | 280/11.2 X |
| 2,315,342 | 3/1943 | Lieberman | 280/11.2 X |
| 2,430,037 | 11/1947 | Vincent . | |
| 2,485,147 | 10/1949 | Fowlkes | 280/11.2 |
| 2,485,923 | 10/1949 | Rumpakis et al. | 280/11.2 X |
| 2,644,692 | 7/1953 | Kahlert | 280/11.2 X |
| 3,104,887 | 9/1963 | Rice et al. | 280/11.2 |
| 3,287,023 | 11/1966 | Ware | 280/11.2 |
| 4,273,345 | 6/1981 | Ben-Dor et al. | 280/11.2 |
| 4,294,455 | 10/1981 | Krueger | 280/11.2 |
| 4,298,029 | 11/1981 | Peters . | |
| 4,379,564 | 4/1983 | Welker . | |
| 4,418,929 | 12/1983 | Gray | 280/11.23 |
| 4,909,523 | 3/1990 | Olson | 280/11.2 |
| 5,028,058 | 7/1991 | Olson . | |
| 5,046,746 | 9/1991 | Gierveld | 280/11.27 X |
| 5,048,848 | 9/1991 | Olson et al. | 280/11.27 X |
| 5,052,701 | 10/1991 | Olson | 280/11.2 |
| 5,067,736 | 11/1991 | Olson et al. | 280/11.2 |
| 5,171,033 | 12/1992 | Olson et al. | 280/11.22 |
| 5,207,438 | 5/1993 | Landers | 280/11.2 |
| 5,253,883 | 10/1993 | Moldenhauer | 280/11.27 X |

FOREIGN PATENT DOCUMENTS

| | | |
|---|---|---|
| 14276 | 6/1909 | United Kingdom . |
| 20811 | 9/1909 | United Kingdom . |
| 453425 | 9/1936 | United Kingdom . |

OTHER PUBLICATIONS

"Roller Stop" product brochure and order forms 6 pp. Roller Stop, Inc. Malden, MA 1992–1993.

Greene, J. "Roller Stop In–line braking system," from *The Bay Skate Magazine*, pp. 4–5. (date unknown).

"Blade Brake Description," *Sporting Goods Business*, vol. 26, No. 2. Feb. 1993.

"Kristi Street Style" product advertisement, Seneca Sports, Inc., from *In–Line Retailer*, v.3:7, Nov. 15, 1994.

*Primary Examiner*—Michael Mar

*Attorney, Agent, or Firm*—George Kapsalas

[57] ABSTRACT

Brake assemblies for in-line roller skates utilize a brake pad and a support member having portions extending forward of the front wheel. The brake support may fasten to the forward portion of the skate side rail by two bolts substituted for two of the skate's wheel bolts. Tabs or a groove, and a screw secure the replaceable brake pad to the forward portion of the brake support. The pad extends around the front of the front wheel and also at least partially around to the side of the front wheel on the brake support surface. The brake support member may be formed as an integral part of the side rail extending forward of the front wheel. These arrangements allow the skater to brake safely by tipping the foot downwardly or by dragging the foot to the side.

25 Claims, 5 Drawing Sheets

FIG. 1
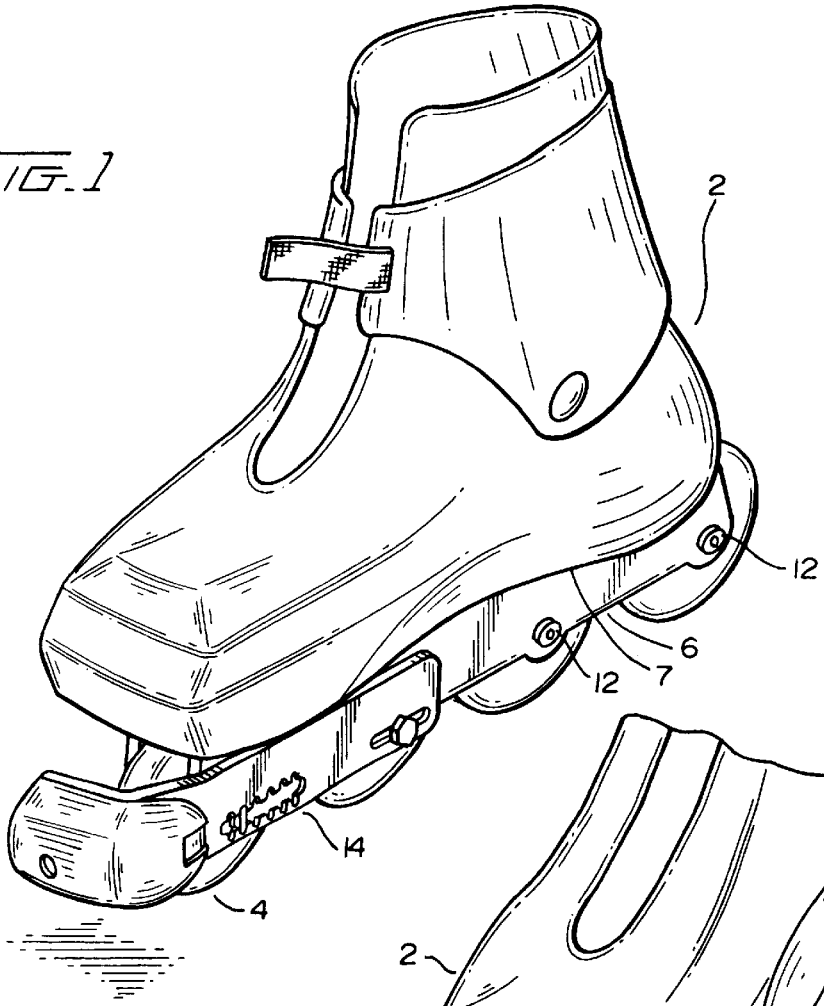
FIG. 2
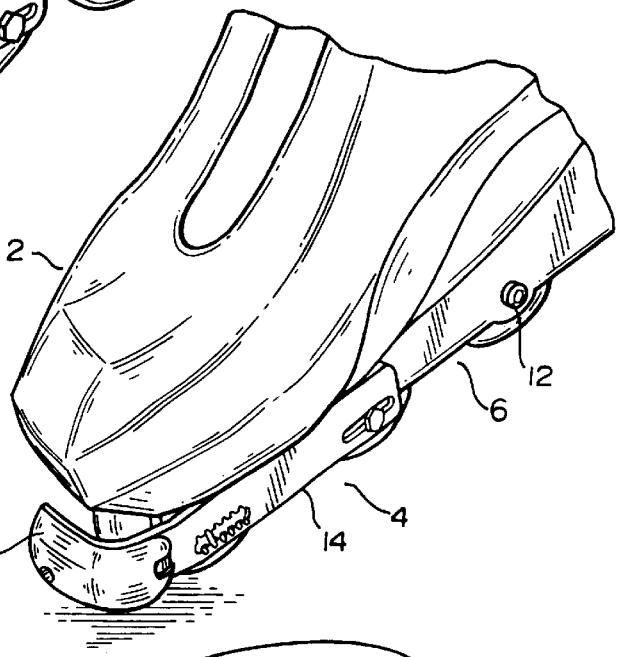
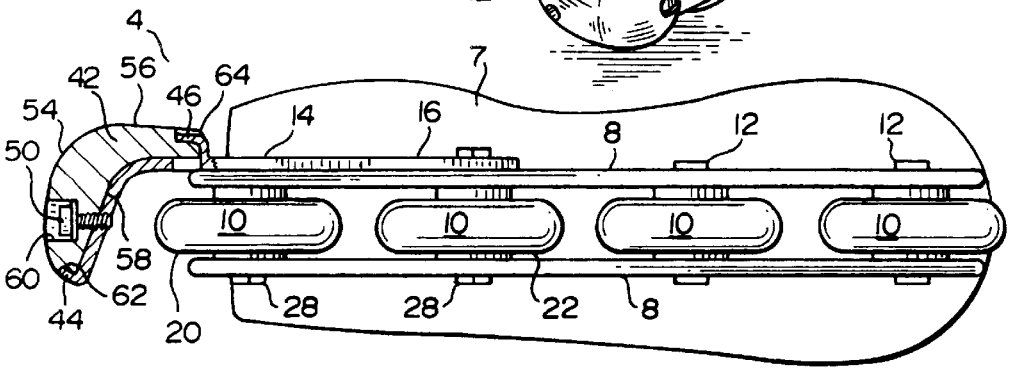
FIG. 3

IN-LINE SKATE BRAKES

BACKGROUND OF THE INVENTION

1. Field of the Invention

The invention relates to improved brakes for in-line roller skates. In-line roller skates have a plurality of wheels rotatable in a common plane and carried by a frame secured to a skate boot or shoe. In order to permit safe, controlled skating, these skates must enable the skater to brake for slowing and stopping in an effective manner.

2. Description of the Prior Art

In-line roller skate braking has most frequently been effected by one or more of four well-recognized techniques. A common brake assembly for in-line skates comprises a heel brake attachment on one or both of the skates. The heel brake includes a brake pad connected to a brake pad support located at the rear of the skate frame, behind the rear wheel. Examples of this conventional arrangement are illustrated in U.S. Pat. Nos. D315,941; 5,052,701; and, 5,067,736. Heel brakes such as these are actuated by the skater pivoting the foot rearwardly to tip the toes upward and swing the skate from a normal coasting position to a position in which the brake pad drags the skating surface. Typically, a skater must pivot the skate boot through an angle of twelve or more degrees to engage the brake. Pivoting of the foot in this manner jeopardizes the skater's balance and may lead to a fall and serious bodily injury. As a result, braking with the heel brakes has proven particularly difficult for inexperienced skaters, who find it intimidating to pivot the foot rearwardly. Furthermore, use of the heel brake requires a skater to shift and maintain his weight towards the rear and away from the direction of motion and thus positions him poorly in preparation for any subsequent skating action or maneuver. Another disadvantage of prior art heel brakes resides in their tendency to snag or catch on certain inclines or in irregular cracks in the skating surface. Therefore, heel braking with prior art heel brakes has not proven satisfactory.

A second prior art technique for in-line skate braking utilizes toe brakes or stops. These brakes typically comprise a friction pad located at a forward portion of the boot or frame. Examples of this second conventional arrangement include U.S. Pat. Nos. D326,700; and 3,287,023. The structure and location of these prior art toe brakes require the skater to lean forward to engage the brake and thus may adversely affect the skater's balance and even cause a fall. The location of these prior art brakes increases the likelihood that the boot or frame will sustain damage in braking actions and renders it difficult to quickly engage a large brake pad area for rapid braking. Thus, toe braking with prior art toe brakes also has not proven satisfactory.

A third prior art technique for in-line skate braking is called the T-stop. The T-stop is effected by placing the rear skate perpendicular to the direction of forward motion and dragging an instep braking surface while pressing downward. The instep braking surface may be a braking pad or pads as shown in U.S. Pat. No. 4,273,345, or it may comprise only the inner edges of one or more of the wheels, without a brake pad. A similar braking action is involved in a fourth, related prior art technique called the power stop, in which the front skate is placed sideways at a sharp angle so as to similarly engage an instep braking surface which may be a braking pad or pads or which may comprise only the inner edges of one or more wheels. T-stop braking or power braking without a brake pad causes uneven wear of the in-line skate wheels and may damage the instep side of the expensive boot, frame, and rails. The motions required to bring and maintain the skate wheels into braking action position may lead to a fall and bodily injury or to a turned ankle. On the other hand, prior art in-line skate brakes for T-stop and power braking as embodied in U.S. Pat. No. 4,273,345, are complex and not generally adaptable for use with the vast majority of in-line skates currently in use or marketed. Attachment of these side brakes to in-line skate frames requires special provisions for fasteners on the frames or rails of the skate. Wear of the brake pads in use requires replacement of complex assemblies or parts. Thus, the in-line skate side brakes of the prior art have not proven effective or popular. For these reasons, both T-stop and power braking have not proven fully satisfactory in prior practice, and prior art brakes usable in T-stop and power braking have not proven practical.

SUMMARY OF THE INVENTION

Accordingly, it is a primary object of this invention to provide improved in-line skate brake assemblies overcoming many of the problems and disadvantages of prior skate braking apparatus and techniques and permitting more effective braking.

It is a further object of this invention to provide practical in-line skate brake assemblies adapted for fitting onto a large variety and types of in-line skates.

The improved in-line skate brake assemblies include a brake pad support member connected to the in-line skate frame at plural securement points over a range of securement point separation distances. The brake pad support member may attach to securement points located at wheel axle bores over a range of axle separation distances. Detents on the support member securely retain the brake pad support against movement relative to the skate frame. Posts or shims may be employed between the support member and skate frame to adjust the orientation of the brake assembly. An alternative brake pad support member configuration includes the support member as an integral part of the skate frame.

The brake pad support members according to the present invention include a portion extending forward of and at least partially across the path of a forward skate wheel. A replaceable brake pad is attached to the support member so as to extend at least partially forward of the front skate wheel and at least partially to the side of the front wheel.

The brake pad may take a variety of configurations. The pad has front, side, and back portions. The front portion may have a bore for a securement screw. The front and side portions may be provided with tab-receiving portions, or the side portion may be provided with a slot. The pad may also be provided with braking surface-engaging ridges. The brake pad is preferably removably secured to the support so as to be replaceable after it wears.

In-line skate brake assemblies according to the invention provide practical and effective brakes for toe and side braking.

These and other objects and advantages of the invention will appear more fully from the following description made in conjunction with the accompanying drawings wherein like reference labels refer to same or similar parts throughout the several views.

BRIEF DESCRIPTION OF THE DRAWINGS

FIG. 1 is a perspective view of an in-line skate with an attached brake assembly of a first configuration embodying the invention.

FIG. 2 is a perspective view of the skate and brake assembly of FIG. 1 in a position approaching a possible braking position.

FIG. 3 is a bottom view, in partial section, of the skate rails, wheels, and brake assembly of the first configuration.

DETAILED DESCRIPTION OF THE PREFERED EMBODIMENTS

Figure 4:
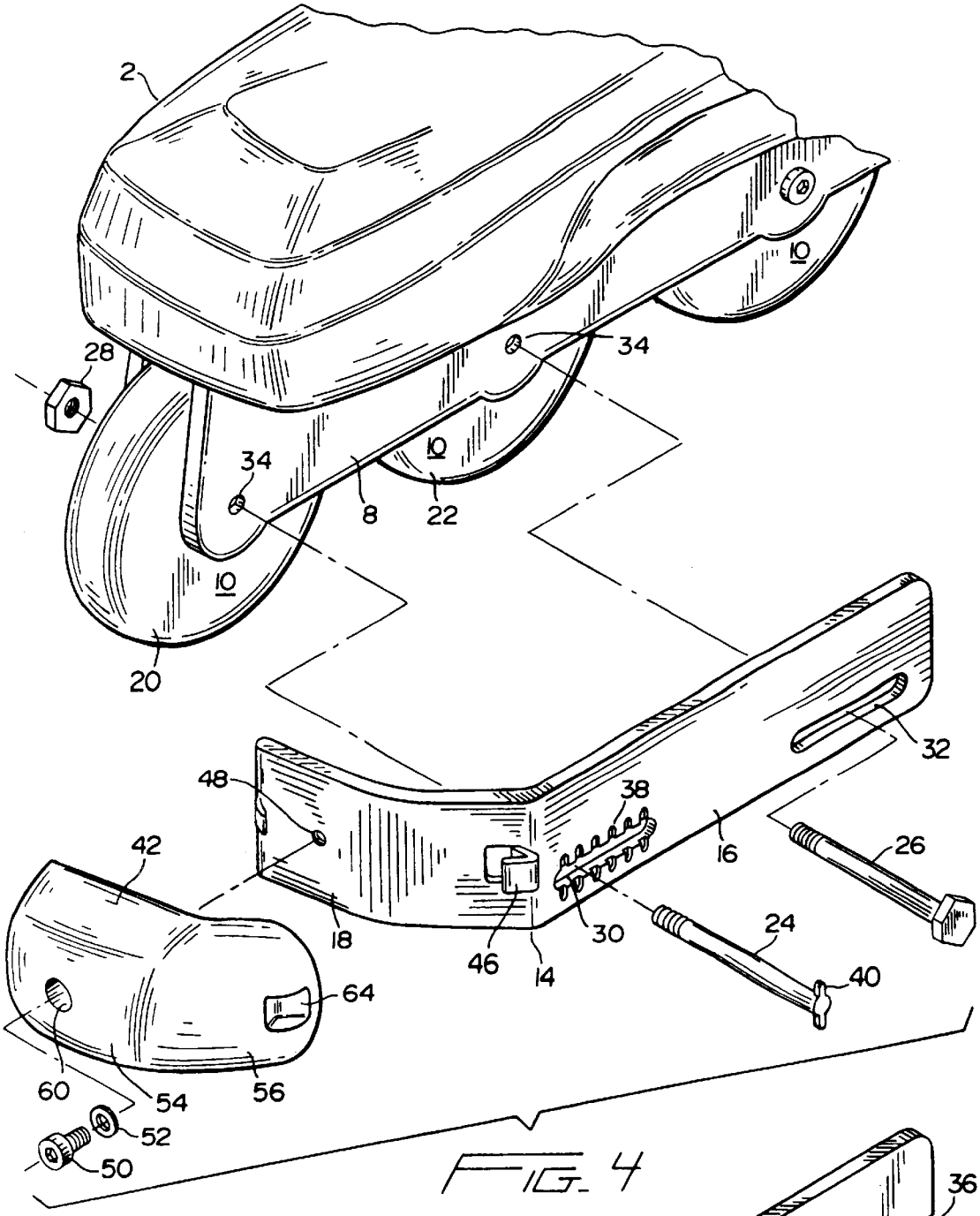
FIG. 4 is an exploded perspective view of the brake assembly shown in FIGS. 1–3.

FIGS. 1–4 illustrate an in-line skate 2 with a first brake assembly 4. The skate is an in-line skate of any conventional type, which, while depicted with a boot in the several views, may include a partial boot only or shoe attachment straps as is well known in the prior art. The skate has an upper frame 7 a lower frame 6 including two rails 8 of any conventional type. The rails support a plurality of wheels 10, which may number from two to four or more, in-line with wheel bolts 12. An element for supporting a brake pad is attached to frame 6,7. The brake pad support member 14 is attached to the frame 6, preferably to the instep rail 8 as shown in FIG. 3.

Figure 5:
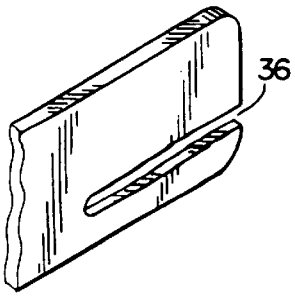
FIG. 5 is a perspective view of an alternative configuration for the end of the brake pad support shown in FIGS. 1–4 embodying the invention.

As shown in FIG. 4, the brake pad support member 14 has a connecting portion 16 and a forward portion 18. The connecting portion 16 is adapted to facilitate attachment of the brake assembly 4 to an in-line skate at plural securement points. The assembly 4 is preferably attached by removing the wheel bolts 12 from the front two wheels 20, 22 and substituting first and second brake support axle bolts 24, 26 therefore. Brake support bolts 24, 26 are preferably made of steel and when tightened to nuts 28 retain the support member 14 to the rail. The nuts 28 may be provided with vibration-resistant threads to guard against inadvertent loosening. Elongated channels 30, 32 in the connecting portion 16 accommodate a range of separation distances between the wheel axle bores 34. As will be well understood by artisans in this field, a plurality of frame securement points other than the axle bores 34 may equivalently serve to anchor a brake support member 14, in which case the elongated channels 30, 32 similarly function to accommodate a range of separation distances between the securement points. As further shown in FIG. 5, one of the channels may be an open channel 36 allowing greater ease of assembly. As best depicted in FIG. 4, one of the channels may have peripheral detents 38 which receive a mating head 40 of the corresponding bolt 24 to firmly position the brake support 14 on the frame 6. This arrangement both accommodates different wheel axis-to-wheel axis dimensions on different brands and types of skates and permits secure positioning of the support 14 on the skate so that the support does not accidentally slide under pressure.

The brake pad support member forward portion 18 is preferably integrally connected to connecting portion 16 as shown in FIG. 4, and both are preferably suitably formed of a relatively rigid structural plastic such as nylon, ABS, or other conventional rigid plastic or composite material, although aluminum, steel, or other metals may also be used. The forward portion 18 is adapted to extend forward of and at least partially across the path of forward skate wheel 20.

Figure 6:
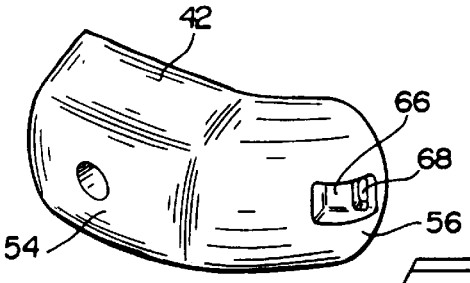
FIG. 6 is a perspective view of an alternative brake pad embodying the invention.

A brake pad 42, as shown in FIGS. 3–4,6, is secured to the brake support member 14. A plurality of tabs 44, 46, shown in FIG. 4 and shown in cross section in FIG. 3, attach and retain the brake pad 42 to the support member 14. A bore 48 in the forward portion 18 receives a cap screw 50 passing through a washer 52. The cap screw 50 may be a nylon cap screw holding brake pad 42 in place. As shown in FIGS. 1–4, the brake pad preferably extends at least partially on both the connecting 16 and forward 18 portions of brake support member 14.

The brake pad 42 has forward 54, side 56, and concave back 58 portions, as shown in FIGS. 3–4,6, and is preferably made of a conventional roller skate brake pad material such a urethane, rubber, or the like, typically having hardness in an 85A to 95A durometer range. The pad has a bore 60 in the forward portion 54 for receiving the cap screw. Tab-receiving portions 62 and 64 receive tabs 44 and 46, respectively. As shown in the configuration of FIG. 6, the tab-receiving portion 66 may have a slot 68 extending through the brake pad side 56 to pass the tab 46.

In use, the brake support member 14 with brake pad 42 is attached to the skate frame 6, and the skate 2 is placed in service. To initiate braking action, a user tips the foot downwardly as shown in FIG. 2 and drags the foot to the rear or to the side for toe or side braking. This results in effective braking and avoids placing the user in the awkward position of tipping the toes upwardly as required in heel braking. As wear on the pad 42 accrues, it may be replaced by loosening screw 50 and securing a new brake pad to the support member.

Figure 14:
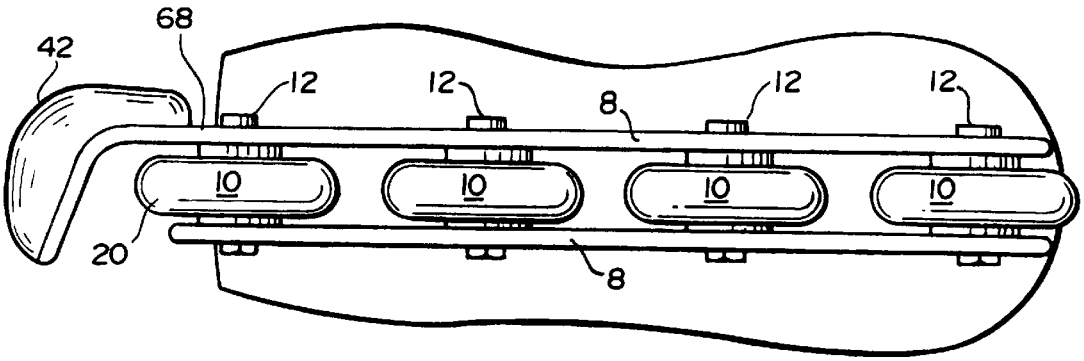
FIG. 14 is a bottom view of the skate rails, wheels, and brake assembly of a fourth configuration embodying the invention.

In a related configuration, as shown in FIG. 14, the brake pad support member 68 is an integral part of a rail 8, preferably the instep rail as shown. The other features of the support member 68 and pad 42 are similar to those of the configurations shown in FIGS. 1–4,6.

FIGS. 7–10 illustrate an in-line skate 2 with a second brake assembly 70 having a brake pad support member 72. The brake pad support member 72 has a connecting portion 74 and a forward portion 76. The connecting portion 74 facilitates attachment of the brake asembly 72 to an in-line skate similarly to the way connecting portion 16 facilitates attachment of assembly 4 to a skate. Elongated grooves 30, 32 play a similar role. The outer edge 33 of channel 32 is reamed to seat the tapered head 29 of wheel bolt 27. The elongated channels 30, 32 accommodate a range of separation distances between wheel axle bores 34. The connecting portion 74 includes a raised tongue 78 adapted to fit a slot 82 in brake pad 80 to secure the brake pad to support member 72, as shown in section view in FIG. 9.

Figures 7, 8:
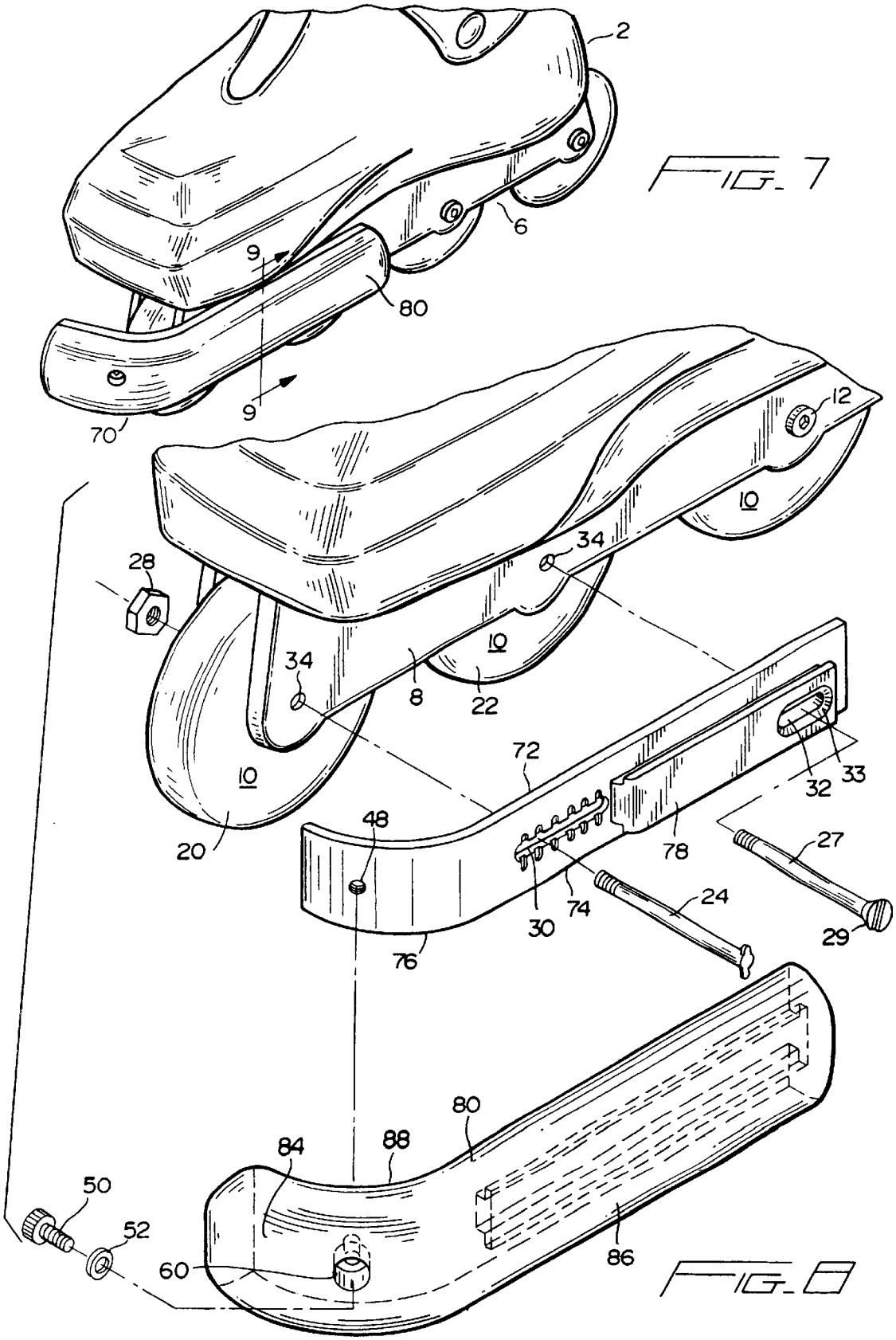
FIG. 7 is a perspective view of an in-line skate with an attached brake assembly of a second configuration embodying the invention.
FIG. 8 is an exploded perspective view of the brake assembly of FIG. 7.
Figure 10:
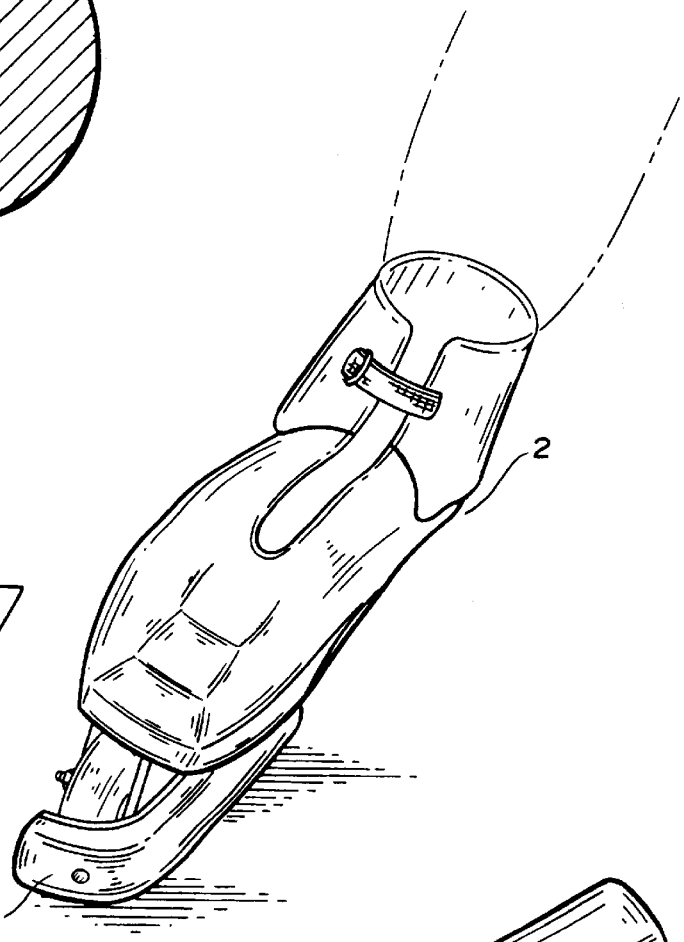
FIG. 10 is a perspective view of an in-line skate with an attached brake assembly of the second configuration in one possible braking position.

The brake pad support member forward portion 76 is preferably integrally conected to portion 74 as shown in FIG. 8 and both portions are suitably formed of materials like those used for support member 14. As shown in FIGS. 7 and 10, forward portion 78 is adapted to extend forward of and at least partially across the path of forward skate wheel 20.

Figure 9:
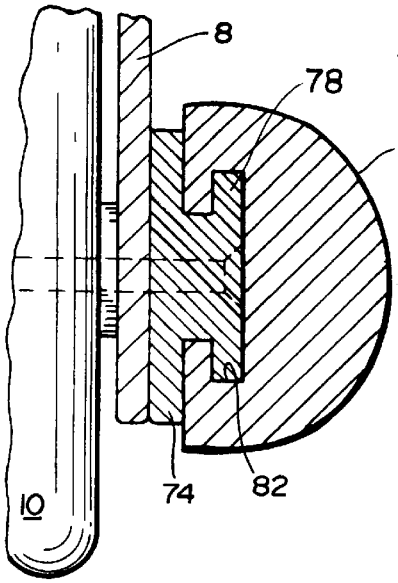
FIG. 9 is a cross section view taken along line 9—9 of FIG. 7.

The brake pad 80 as shown in FIGS. 8–10 is secured to the brake support member 72 by the tongue 78 received in slot 82 and by cap screw 50 received in bore 48 of the forward portion 76. As shown in FIGS. 7–10, the brake pad 80 preferably extends at least partially on both the connecting 74 and forward 76 portions of brake suport member 72.

Figure 11:
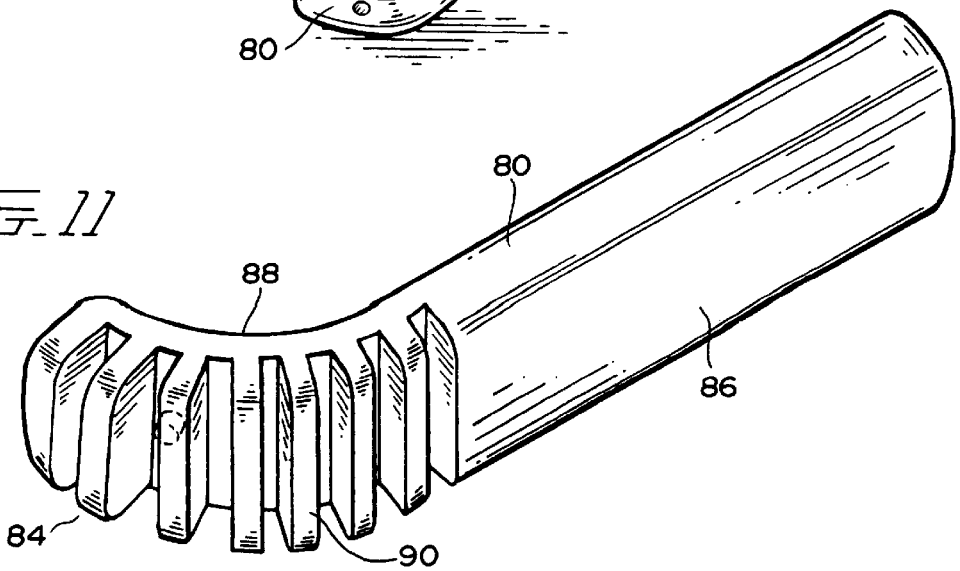
FIG. 11 is a perspective view of an alternative brake pad embodying the invention.

The brake pad 80 has forward 84, side 86, and concave back 88 portions as shown in FIGS. 8 and 11 and is preferably made of a conventional roller skate brake pad material such as urethane, rubber, or the like. The pad 80 has a bore 60 in the forward portion 84 for receiving a screw 50 to retain the pad to the brake support member 72. The slot 82 in the back portion 88 may be formed during molding of the brake pad 80 or may be machined subsequent to molding. As shown in the configuration of FIG. 11, ridges 90 may be provided on the forward and side portions if desired. These ridges 90 may enhance braking action on some braking surfaces.

Figure 12:
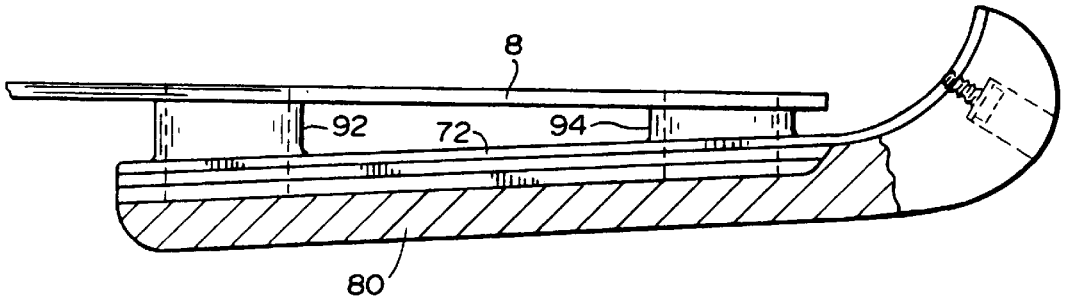
FIG. 12 is a plane view, in partial section, of a skate rail and skate brake assembly of a third configuration embodying the invention.
Figure 13:
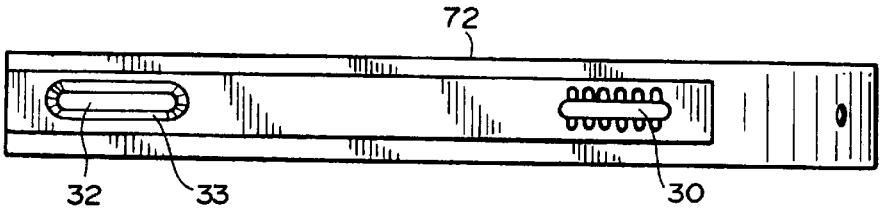
FIG. 13 is a plane view of the brake pad support shown in FIG. 12.

In yet another configuration, as shown in FIGS. 11–12, pad 80 is mounted on a brake pad support member 72 which sits on integral posts or shims 92, 94. The posts or shims may equivalently be made as separate pieces to be assembled between the brake assembly and the skate frame, as will be readily apparent to artisans in this field. Such posts or shims placed between the brake pad support member and a frame serve to adjust the orientation of the brake pad relative to the skate frame for optimum braking action.

In use, the brake pad support member 72 with brake pad 80 is attached to the skate frame 6. To initiate braking action, a user may tip the foot downwardly and drag it to the rear or to the side, or may drag the foot in a turned-out or turned-in position as shown in FIG. 10. After wear on the pad 42 accrues, the pad may be replaced by removing screw 50 and securing a new brake pad.

The prefered embodiments of the invention having been described, it should be understood that various changes, adaptations, and modifications may be made therein without departing from the spirit of the invention and the scope of the invention.

We claim:

1. An in-line skate brake pad support, said support comprising a first portion adapted to attach to an in-line skate rail at a region proximate to at least two forward wheel bolt bores, a second portion adapted to extend forward of and at least partially across the bounded in-line path of a forward skate wheel, said second portion presenting a forward-facing surface adapted to contact a rear portion of a brake pad thereon, said second portion connected to said first portion.

2. An in-line skate brake pad support as claimed in claim 1, further comprising means for attaching a brake pad to said first and second portions.

3. An in-line skate brake pad support as claimed in claim 2, wherein said means is located at least on said first and second portions.

4. An in-line skate brake pad support as claimed in claim 3, wherein said means comprises a bore and a tongue.

5. An in-line skate brake pad support as claimed in claim 2 wherein said means comprises a bore and a tab.

6. An in-line skate brake pad support as claimed in claim 1, wherein said second portion is integrally connected to said first portion.

7. An in-line skate brake pad support as claimed in claim 1, further comprising means for attaching said support to said rail.

8. An in-line skate brake pad support as claimed in claim 7, wherein said means for attaching said support to said rail includes at least one elongated channel in said first portion.

9. An in-line skate with a brake assembly as claimed in claim 2, wherein said means comprises a bore in said support member.

10. An in-line skate with a brake assembly as claimed in claim 9, wherein said means comprises a screw.

11. An in-line skate brake pad support comprising a support member having at least two elongated channels permitting passage of respective wheel bolts of at least two forward skate wheels therethrough to attach said support member to a skate rail, said elongated channels functioning to accommodate a range of separation distances between said wheel bolts and to permit selective location of said support member relative to said rail, and, peripheral detents surrounding at least one of said elongated channels.

12. A roller skate brake assembly comprising:

means for supporting a brake pad, said means having a connecting portion and a forward portion, said connecting portion adapted to extend along at least one side of a forward skate wheel and adapted to attach to at least one rail of an in-line skate, said forward portion adapted to extend forward of and at least partially across the bounded in-line path of a forward skate wheel so as to extend forward to complete clearance of contact with forwardmost portions of rails of said skate, and, a brake pad adapted to be irrotatably mounted on said means, wherein said brake pad is secured to said means so as to extend at least partially on both said connecting and forward portions of said means.

13. A roller skate brake assembly as claimed in claim 12, further comprising a securement slot in said brake pad.

14. A roller skate brake assembly as claimed in claim 12, further comprising second means functioning to attach said connecting portion to a skate frame.

15. An in-line skate with a brake assembly, comprising:

a skate frame with rails supporting a plurality of skate wheels in-line, a brake pad support member attached to said frame at a plurality of noncoaxial securement points, said plurality of securement points including at least two spaced wheel axle bores in a rail of said skate, said brake pad support member having a portion extending from at least one side of to forward of and at least partially across the bounded in-line path of a forward skate wheel, said portion extending forward to complete clearance of contact with forwardmost portions of said rails, a brake pad irrotatably mounted on said support member, and, means for attaching said brake pad support member to said rail, said means accommodating a range of separation distances between said securement points, and said means comprising a plurality of elongated channels in said support member.

16. An in-line skate with a brake assembly as claimed in claim 15, wherein at least one of said elongated channels has peripheral detents.

17. An in-line skate with a brake assembly, comprising:

a skate frame with rails supporting a plurality of skate wheels in-line, a brake pad support member attached to said frame at a plurality of noncoaxial securement points, said brake pad support member having a portion extending from at least one side of to forward of and at least partially across the bounded in-line path of a forward skate wheel, said portion extending forward to complete clearance of contact with forwardmost portions of said rails, a brake pad irrotatably mounted on said support member, and, means for attaching said brake pad to said support member, said means comprising a bore in said support member and a tab on said support member.

18. An in-line skate with a brake assembly, comprising:

a skate frame with rails supporting a plurality of skate wheels in-line, a brake pad support member attached to said frame at a plurality of noncoaxial securement points, said brake pad support member having a portion extending from at least one side of to forward of and at least partially across the bounded in-line path of a forward skate wheel, said portion extending forward to complete clearance of contact with forwardmost portions of said rails, a brake pad irrotatably mounted on said support member, and, means for attaching said brake pad to said support member, said means comprising a bore in said support member and a tongue on said support member.

19. An in-line skate brake pad comprising an integral forward portion and a side portion, said portions each having respective ends, said ends connected by a spanning, concave back portion, and first means on both said forward and side portions for securing said brake pad to a support member.

20. An in-line skate brake pad as claimed in claim 19, said first means comprising a bore in said forward portion.

21. An in-line skate brake pad as claimed in claim 20, said first means additionally comprising a tab-receiving portion on said side portion.

22. An in-line skate brake pad as claimed in claim 21, said first means additionally comprising a tab-receiving portion on said front portion.

23. An in-line skate brake pad as claimed in claim 20, said first means additionally comprising a slot in said side portion.

24. An in-line skate brake pad as claimed in claim 19, wherein said forward portion includes at least one ridge.

25. An in-line skate brake pad as claimed in claim 19, wherein said side portion includes at least one ridge.

* * * * *